US011643292B2

(12) United States Patent
Nakagawa et al.

(10) Patent No.: US 11,643,292 B2
(45) Date of Patent: May 9, 2023

(54) SHEET FEEDING DEVICE

(71) Applicant: CANON KABUSHIKI KAISHA, Tokyo (JP)

(72) Inventors: Hiroyuki Nakagawa, Chiba (JP); Isao Kannari, Saitama (JP); Hiroshi Saito, Ibaraki (JP); Keitaro Taoka, Chiba (JP); Hajime Sekiguchi, Chiba (JP); Kouyou Tamura, Chiba (JP); So Matsumoto, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 17/199,476

(22) Filed: Mar. 12, 2021

(65) Prior Publication Data

US 2021/0300702 A1 Sep. 30, 2021

(30) Foreign Application Priority Data

Mar. 25, 2020 (JP) ..... JP2020-054355

(51) Int. Cl.

| | |
|---|---|
| ***B65H 3/06*** | (2006.01) |
| ***B65H 7/18*** | (2006.01) |
| ***B65H 5/06*** | (2006.01) |
| ***G03G 15/00*** | (2006.01) |

(52) U.S. Cl.

CPC ..... *B65H 7/18* (2013.01); *B65H 3/0669* (2013.01); *B65H 5/062* (2013.01); *G03G 15/6529* (2013.01); *B65H 2511/11* (2013.01)

(58) Field of Classification Search

CPC combination set(s) only.

See application file for complete search history.

(56) References Cited

U.S. PATENT DOCUMENTS

| | | | |
|---|---|---|---|
| 5,046,947 | A | 9/1991 | Endoh et al. |
| 5,154,411 | A | 10/1992 | Saito et al. |
| 5,191,382 | A | 3/1993 | Okamura et al. |
| 5,298,959 | A | 3/1994 | Saito et al. |

(Continued)

FOREIGN PATENT DOCUMENTS

| | | | |
|---|---|---|---|
| EP | 1054301 A2 * | 11/2000 | ..... B65H 5/062 |
| EP | 3002239 A1 * | 4/2016 | ..... B65H 37/00 |

(Continued)

OTHER PUBLICATIONS

Aug. 23, 2021 European Search Report in European Patent Appln. No. 21161422.7.

*Primary Examiner* — Jennifer Bahls

(74) *Attorney, Agent, or Firm* — Venable LLP

(57) ABSTRACT

A sheet feeding device includes a sheet feeding portion, a side end regulating portion, a feeding portion, first and second feeding roller pairs, an abutment member, an obliquely feeding roller pair, and first and second contact-and-separation mechanisms. Feeding of a long sheet is stopped after the sheet is fed to an upstream side of the second feeding roller pair by the feeding portion, and then is resumed in a state in which the first feeding roller pair is changed from a separated state to a feedable state and in a state in which the obliquely feeding roller pair is put in a separated state, and then the sheet is fed to the second feeding roller pair. A short sheet fed by the first feeding roller pair is obliquely fed by the obliquely feeding roller pair and then is fed to the second feeding roller pair.

9 Claims, 13 Drawing Sheets

(56) References Cited

U.S. PATENT DOCUMENTS

| | | | |
|---|---|---|---|
| 5,580,042 | A | 12/1996 | Taniguro et al. |
| 5,620,174 | A | 4/1997 | Taniguro et al. |
| 5,672,019 | A | 9/1997 | Hiramatsu et al. |
| 5,725,319 | A | 3/1998 | Saito et al. |
| 5,918,873 | A | 7/1999 | Saito et al. |
| 6,168,270 | B1 | 1/2001 | Saikawa et al. |
| 6,273,418 | B1 | 8/2001 | Fujikura et al. |
| 6,305,682 | B1 | 10/2001 | Saito et al. |
| 6,545,255 | B2 | 4/2003 | Sato et al. |
| 6,741,815 | B1 | 5/2004 | Fujita et al. |
| 6,834,177 | B2 | 12/2004 | Saito et al. |
| 6,939,064 | B2 | 9/2005 | Kawaguchi et al. |
| 6,954,608 | B2 | 10/2005 | Sekiguchi et al. |
| 6,961,991 | B2 | 11/2005 | Fuseya et al. |
| 6,963,718 | B2 | 11/2005 | Sekiguchi |
| 7,009,158 | B2 | 3/2006 | Sekiguchi et al. |
| 7,027,764 | B2 | 4/2006 | Sekiguchi et al. |
| 7,069,640 | B2 | 7/2006 | Fuseya et al. |
| 7,081,604 | B2 | 7/2006 | Sekiguchi |
| 7,136,601 | B2 | 11/2006 | Akizuki et al. |
| 7,641,188 | B2 | 1/2010 | Hiura et al. |
| 7,900,909 | B2 | 3/2011 | Hiura et al. |
| 8,480,074 | B2 | 7/2013 | Ubayashi et al. |
| 8,550,459 | B2 | 10/2013 | Sekiguchi et al. |
| 8,602,409 | B2 | 12/2013 | Sekiguchi |
| 8,684,353 | B2 | 4/2014 | Miyazawa |
| 8,844,923 | B2 | 9/2014 | Ota et al. |
| 8,864,123 | B2 | 10/2014 | Kamiyama et al. |
| 8,870,178 | B2 | 10/2014 | Taoka et al. |
| 9,302,862 | B2 | 4/2016 | Taoka |
| 9,540,192 | B2 | 1/2017 | Kannari |
| 9,731,919 | B2 | 8/2017 | Saito |
| 10,556,763 | B2 | 2/2020 | Taoka |
| 10,775,730 | B2 | 9/2020 | Nakagawa |
| 10,800,620 | B2 | 10/2020 | Kannari |
| 2008/0112744 | A1 | 5/2008 | Saito |
| 2008/0112745 | A1 | 5/2008 | Saito |
| 2012/0091653 | A1 | 4/2012 | Miyazawa |
| 2016/0280488 | A1* | 9/2016 | Watanabe ..... B65H 9/002 |
| 2019/0018351 | A1 | 1/2019 | Hirose et al. |
| 2019/0025750 | A1* | 1/2019 | Matsumoto ..... G03G 15/1615 |
| 2021/0047139 | A1 | 2/2021 | Kannari |
| 2021/0300704 | A1* | 9/2021 | Taoka ..... G03G 15/6514 |

FOREIGN PATENT DOCUMENTS

| | | | | |
|---|---|---|---|---|
| JP | H11-189355 | A | | 7/1999 |
| JP | 2001-151388 | A | | 6/2001 |
| JP | 2001151388 | A | * | 6/2001 |
| JP | 2011-132022 | A | | 7/2011 |
| JP | 2012-086914 | A | | 5/2012 |
| JP | 2019-020443 | A | | 2/2019 |
| JP | 2019-026452 | A | | 2/2019 |

* cited by examiner

SHEET FEEDING DEVICE

FIELD OF THE INVENTION AND RELATED ART

The present invention relates to a sheet feeding device for feeding (conveying) a sheet.

Conventionally, as disclosed in Japanese Laid-Open Patent Application Hei 11-189355, a sheet alignment means for correcting oblique movement of the sheet on a side registration basis has been proposed. This sheet alignment means causes a side end of the sheet fed (conveyed) by a feeding portion and a feeding roller pair, to abut against an abutment member by an obliquely feeding roller pair.

In the case where a long sheet, for example, an elongated sheet with respect to a sheet feeding direction in which the sheet is fed, is fed, the sheet is fed in some instances in a state in which a nip of each of the obliquely feeding roller pair and the feeding roller pair is separated.

Further, in order to adjust a variation in position of a leading end of the sheet fed, on a side upstream of a registration roller pair, feeding of the sheet is once stopped and then is resumed at predetermined timing.

However, in the case where the feeding of the sheet is once stopped on the side upstream of the registration roller pair and then the sheet is fed again, there is a liability that a slip occurs between the feeding portion and the sheet. In this case, there is a liability that the sheet cannot be fed to the registration roller pair and thus improper feeding such as non-feeding of the sheet or the like occurs.

SUMMARY OF THE INVENTION

A principal object of the present invention is to provide a sheet feeding device capable of reducing a degree of oblique movement of a sheet and a degree of improper feeding of the sheet.

According to an aspect of the present invention, there is provided a sheet feeding device comprising: a sheet supporting portion configured to support a sheet; a side end regulating portion configured to regulate a side end of the sheet supported by the sheet supporting portion; a feeding portion configured to feed the sheet supported by the supporting portion and regulated by the regulating portion; a first feeding roller pair configured to feed the sheet fed by the feeding portion, in a sheet feeding direction; an abutment member which is provided downstream of the first feeding roller pair with respect to the sheet feeding direction, which extends in the sheet feeding direction, and against which a side end of the sheet with respect to a widthwise direction of the sheet is abutted; an obliquely feeding roller pair configured to obliquely feed the sheet in an inclination direction relative to the sheet feeding direction so that the sheet approaches the abutment member in the widthwise direction; a second feeding roller pair provided downstream of the obliquely feeding roller pair with respect to the sheet feeding direction and configured to feed the sheet; a first contact-and-separation mechanism configured to contact and separate the first feeding roller pair so as to be changeable between a first feedable state in which the first feeding roller pair is capable of feeding the sheet while nipping the sheet and a first separated state in which rollers of the first feeding roller pair are in separation from each other; a second contact-and-separation mechanism configured to contact and separate the obliquely feeding roller pair so as to be changeable between a second feedable state in which the obliquely feeding roller pair is capable of feeding the sheet while nipping the sheet and a second separated state in which rollers of the obliquely feeding roller pair are in separation from each other, wherein when the sheet fed has a first length, feeding of the sheet is stopped after the sheet is fed to an upstream side of the second feeding roller pair by the feeding portion in a state in which the first feeding roller pair is put in the first separated state by the first contact-and-separation mechanism, and then is resumed in a state in which the first feeding roller pair is changed from the first separated state to the first feedable state and in a state in which the obliquely feeding roller pair is put in the second separated state by the second contact-and-separation mechanism, and then the sheet is fed to the second feeding roller pair, and wherein when the sheet fed has a second length shorter than the first length, the sheet fed by the first feeding roller pair is obliquely fed by the obliquely feeding roller pair in the second feedable state and then is fed to the second feeding roller pair.

Further features of the present invention will become apparent from the following description of exemplary embodiments with reference to the attached drawings.

Figure 4:
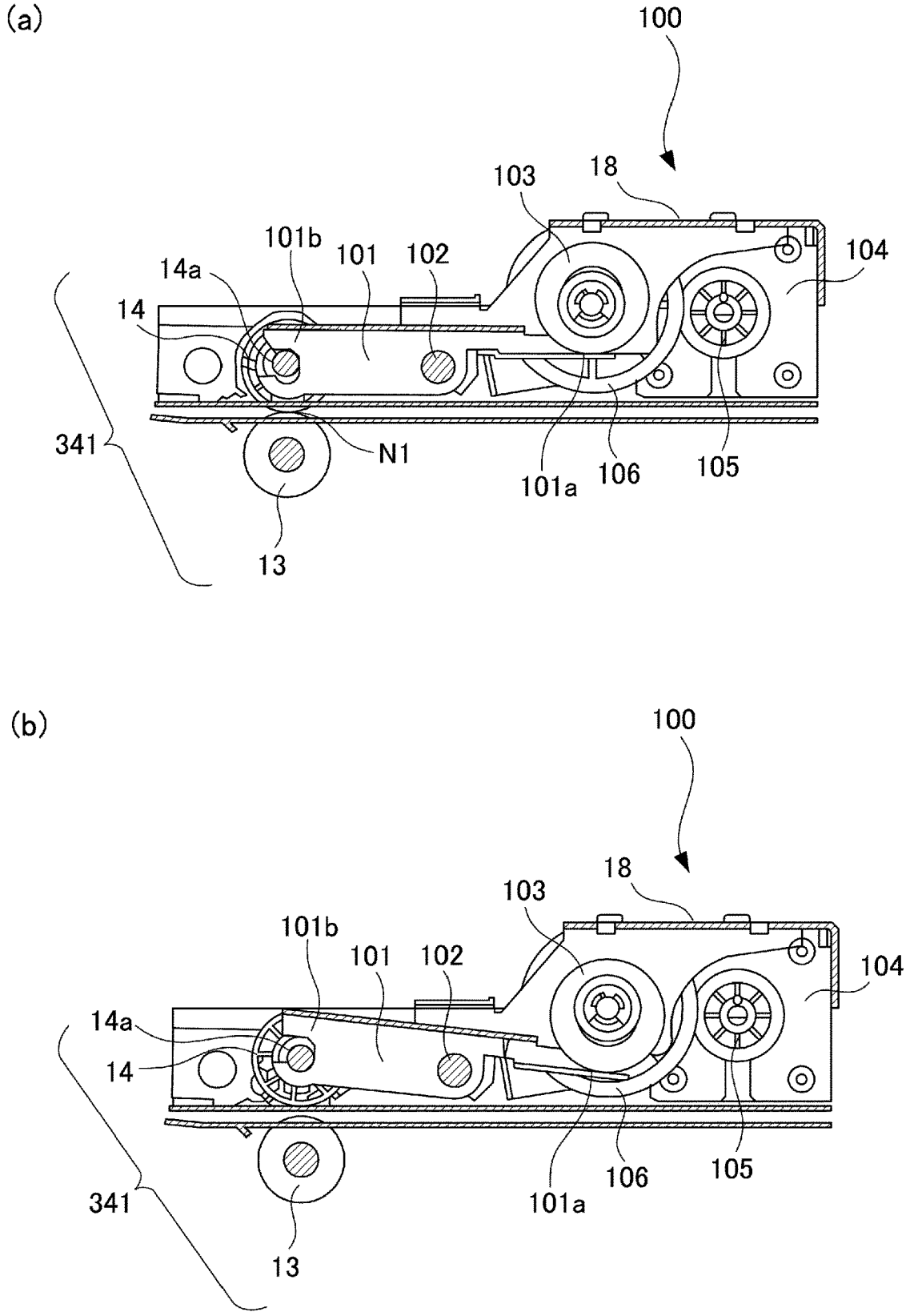

Part (a) of FIG. 4 is a sectional view showing a contact state of the feeding roller pair in the embodiment, and part (b) of FIG. 4 is a sectional view showing a spaced state of the feeding roller pair in the embodiment.

Figure 5:
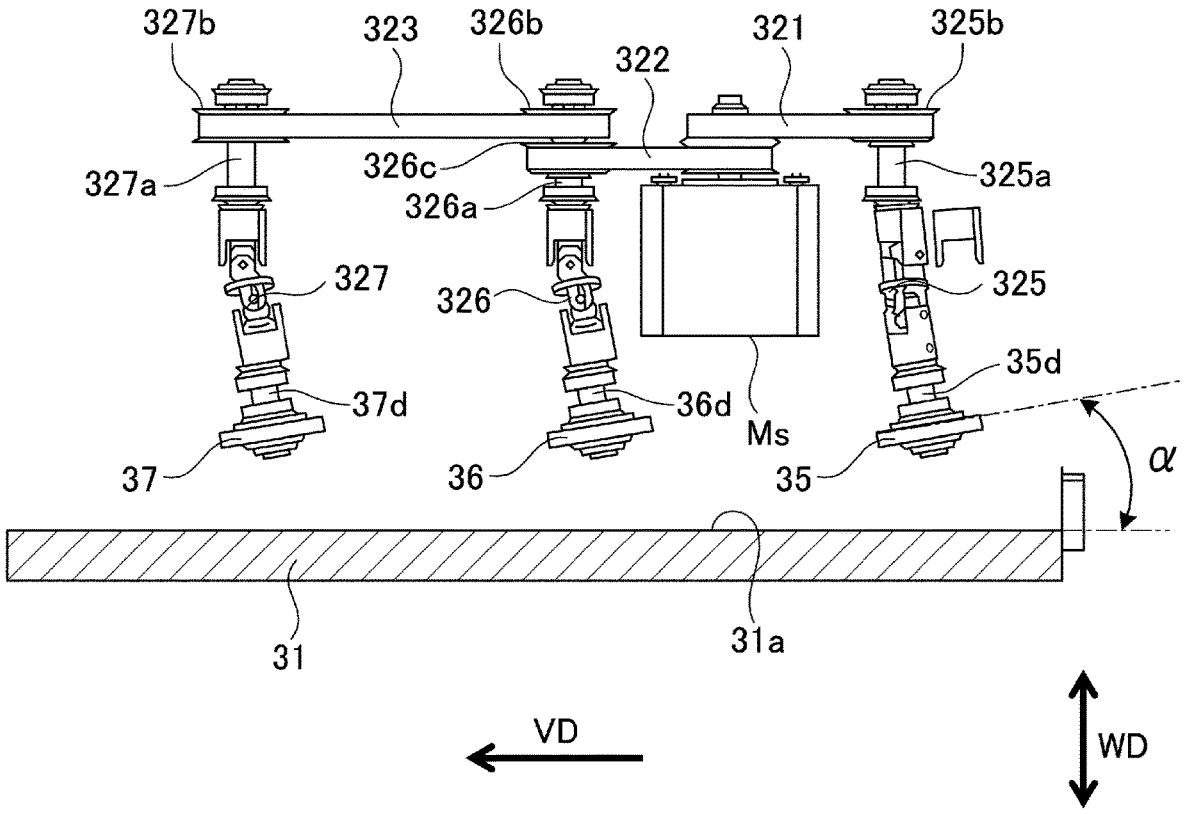

FIG. 5 is a plan view showing an obliquely feeding roller pair and a peripheral structure thereof in the embodiment.

Figure 6:
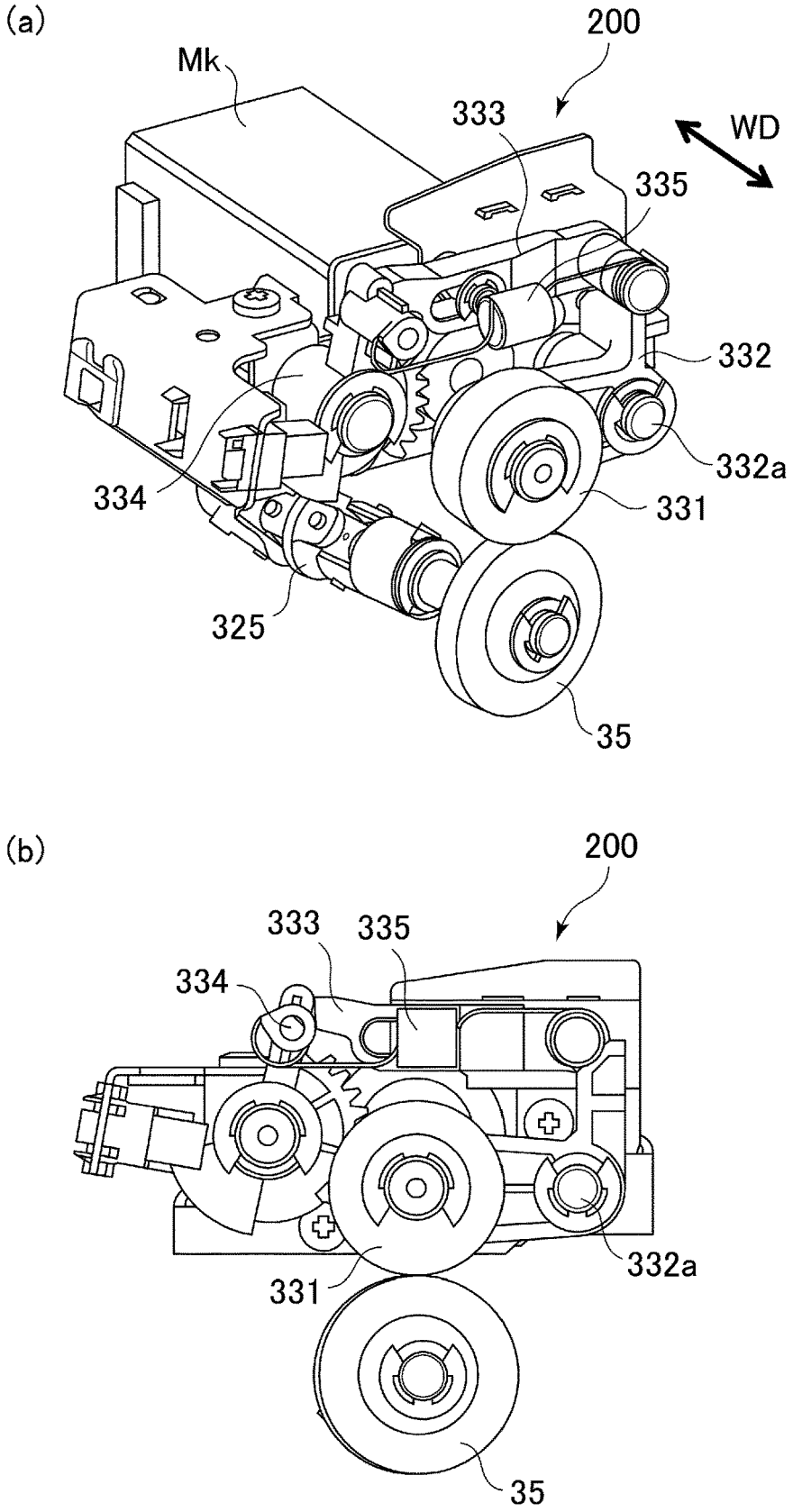

Part (a) of FIG. 6 is a perspective view showing the obliquely feeding roller pair and a contact-and-separation mechanism in a contact state in the embodiment, and part (b) of FIG. 6 is a side view showing the obliquely feeding roller pair and the contact-and-separation mechanism in the contact state in the embodiment.

Figure 7:
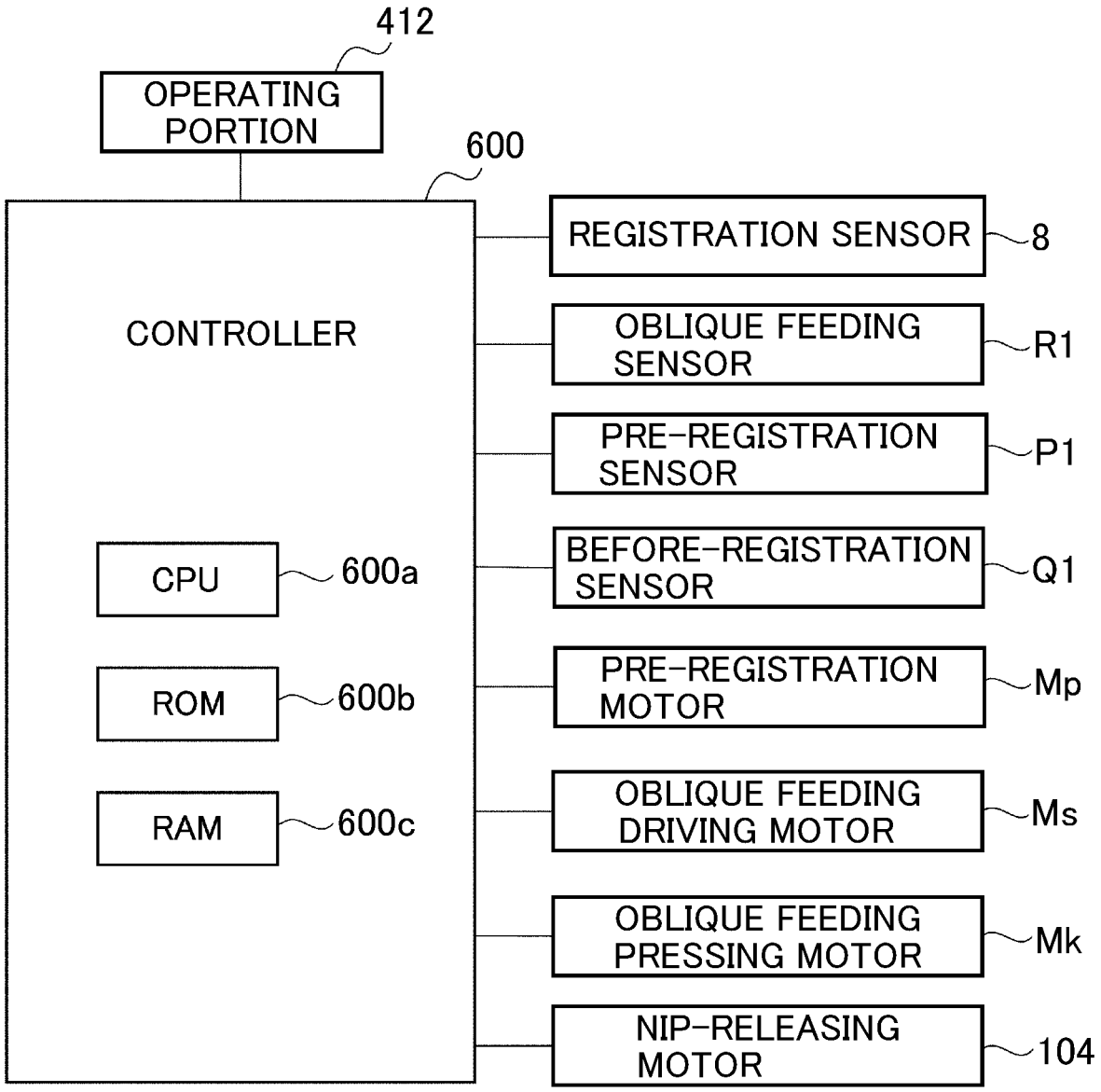

FIG. 7 is a block diagram showing a control system of the image forming apparatus in the embodiment.

Figure 8:
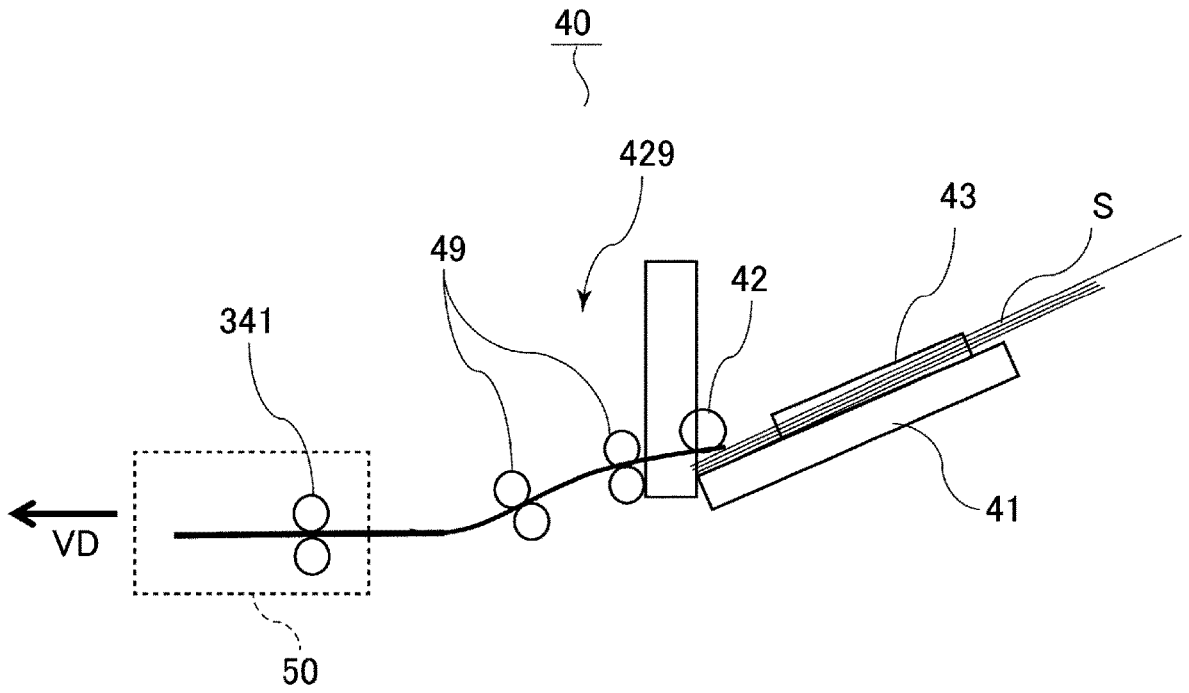

FIG. 8 is a schematic view of a manual feeding portion in the embodiment.

Figure 9:
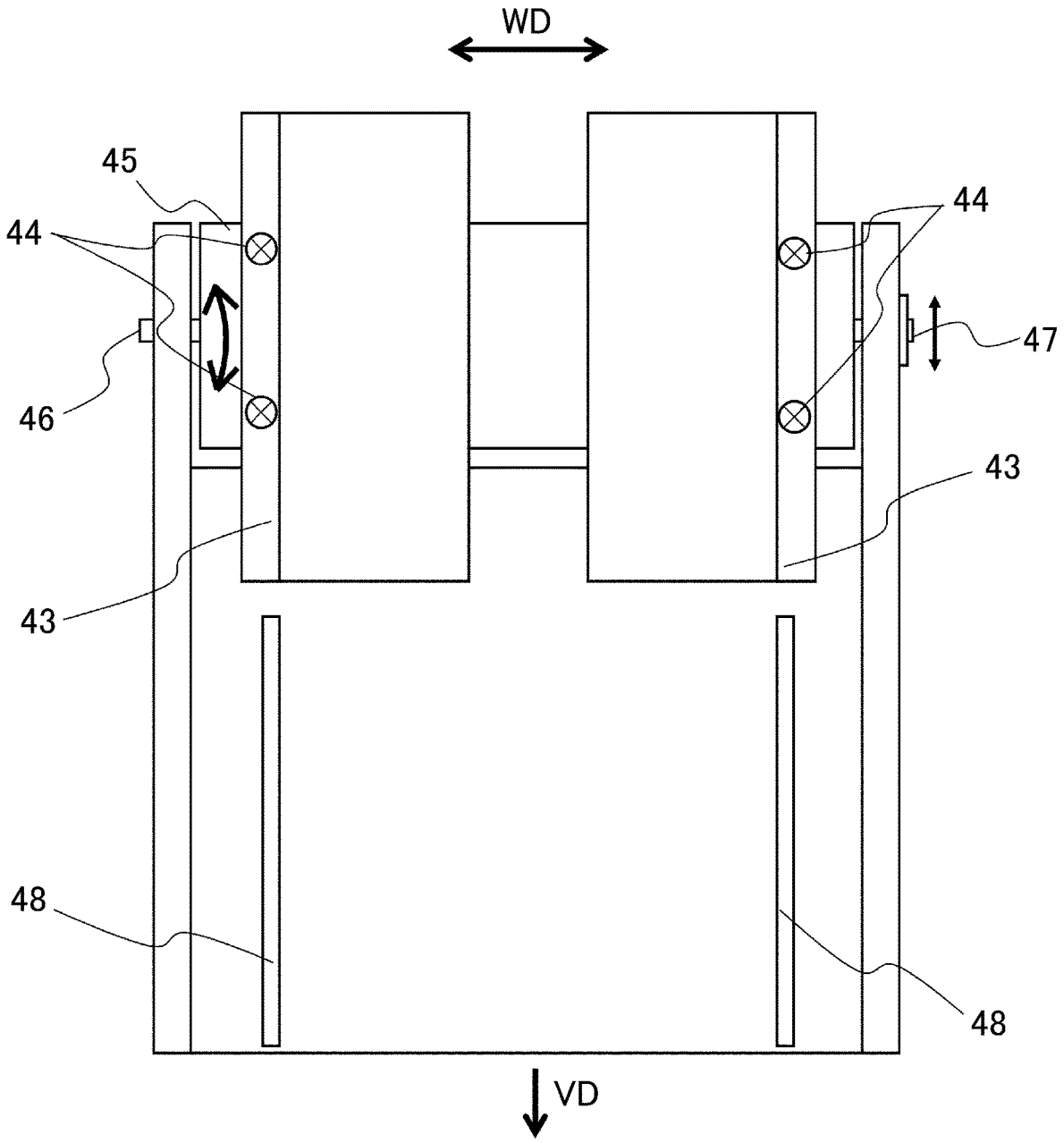

FIG. 9 is a plan view showing a sheet supporting portion in the embodiment.

Figure 10:
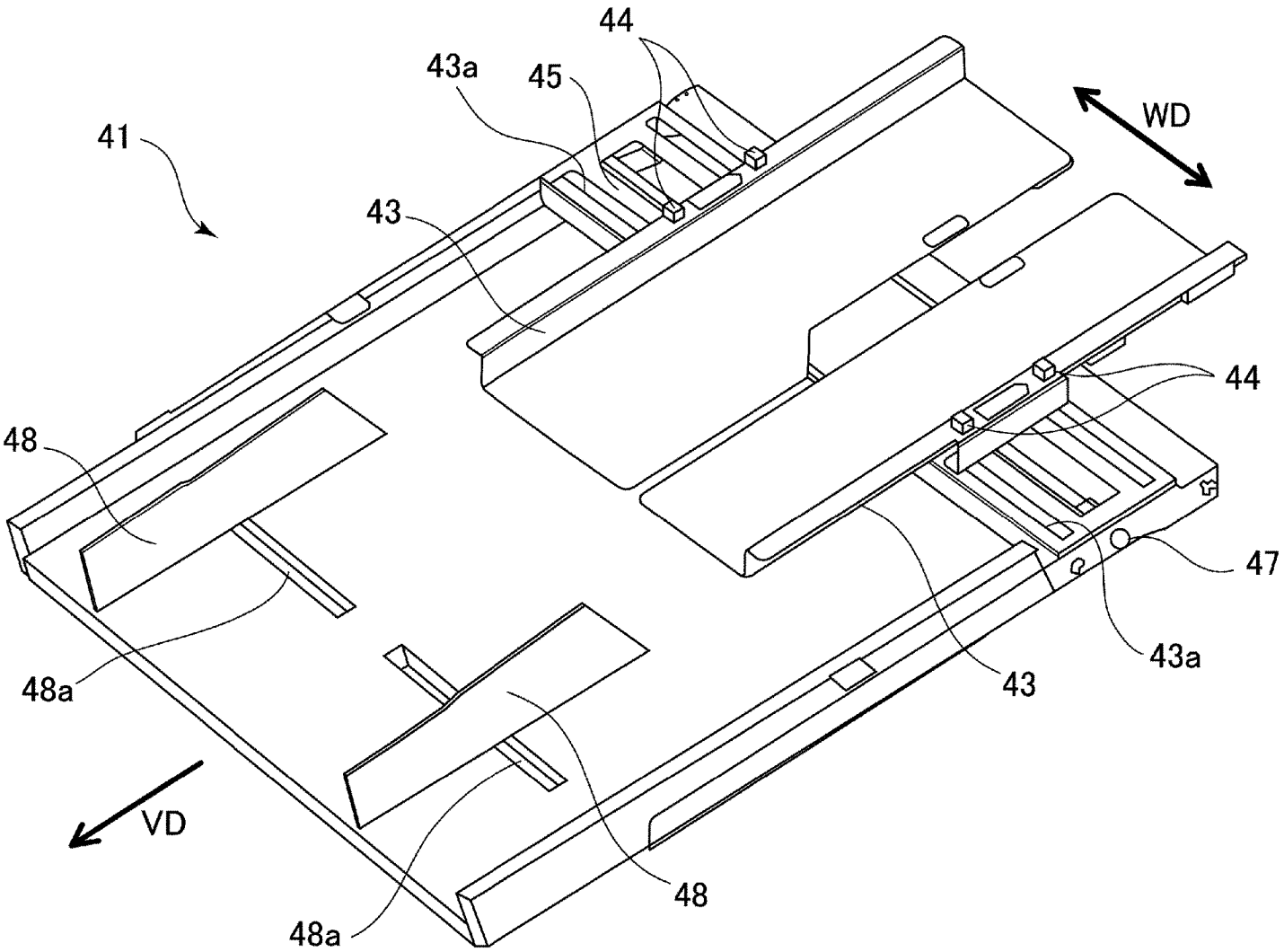

FIG. 10 is a perspective view showing the sheet supporting portion in the embodiment.

Figure 11:
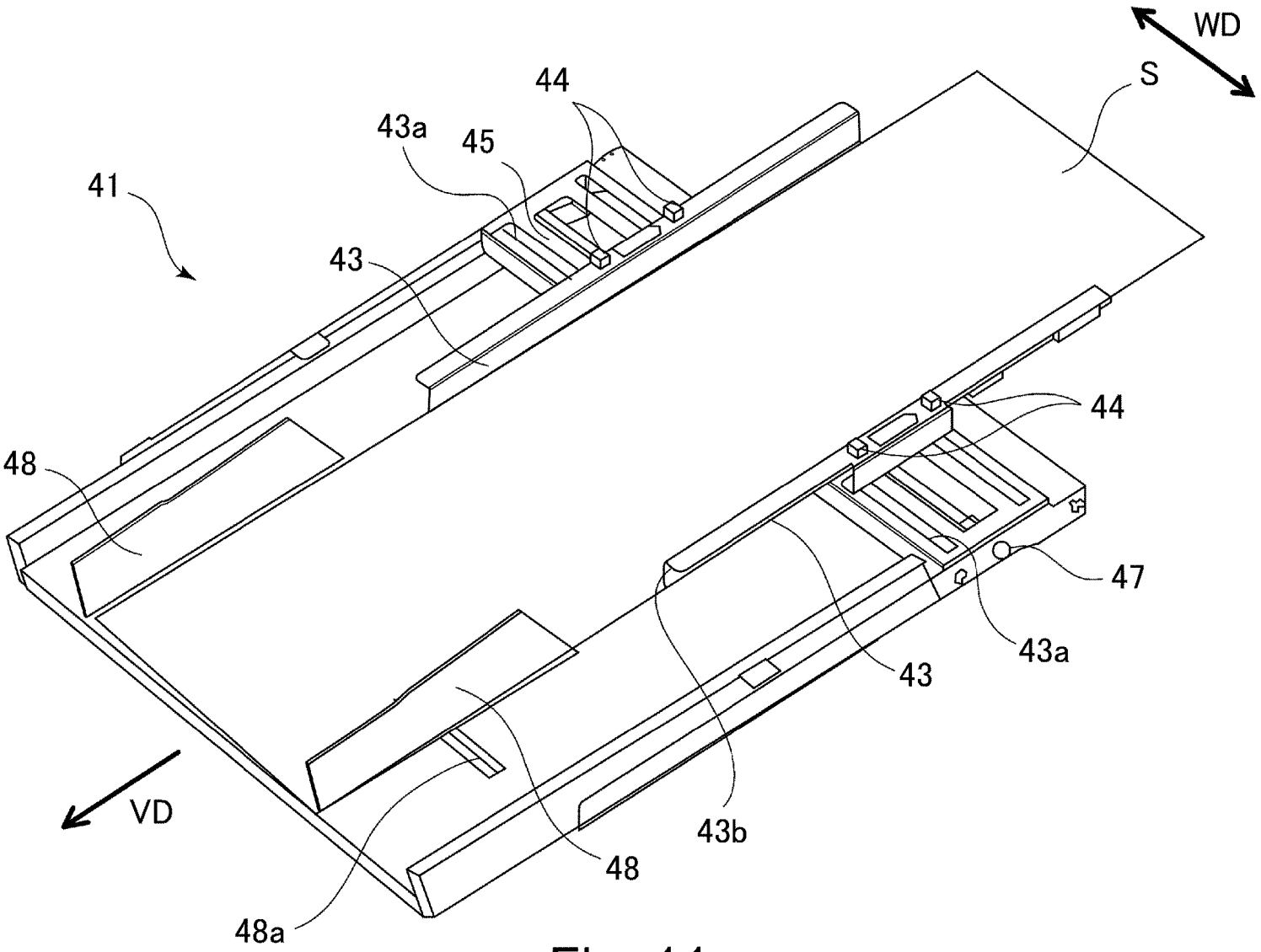

FIG. 11 is a perspective view showing entirety of the sheet supporting portion when an elongated sheet is supported by the sheet supporting portion in the embodiment.

Figure 12:
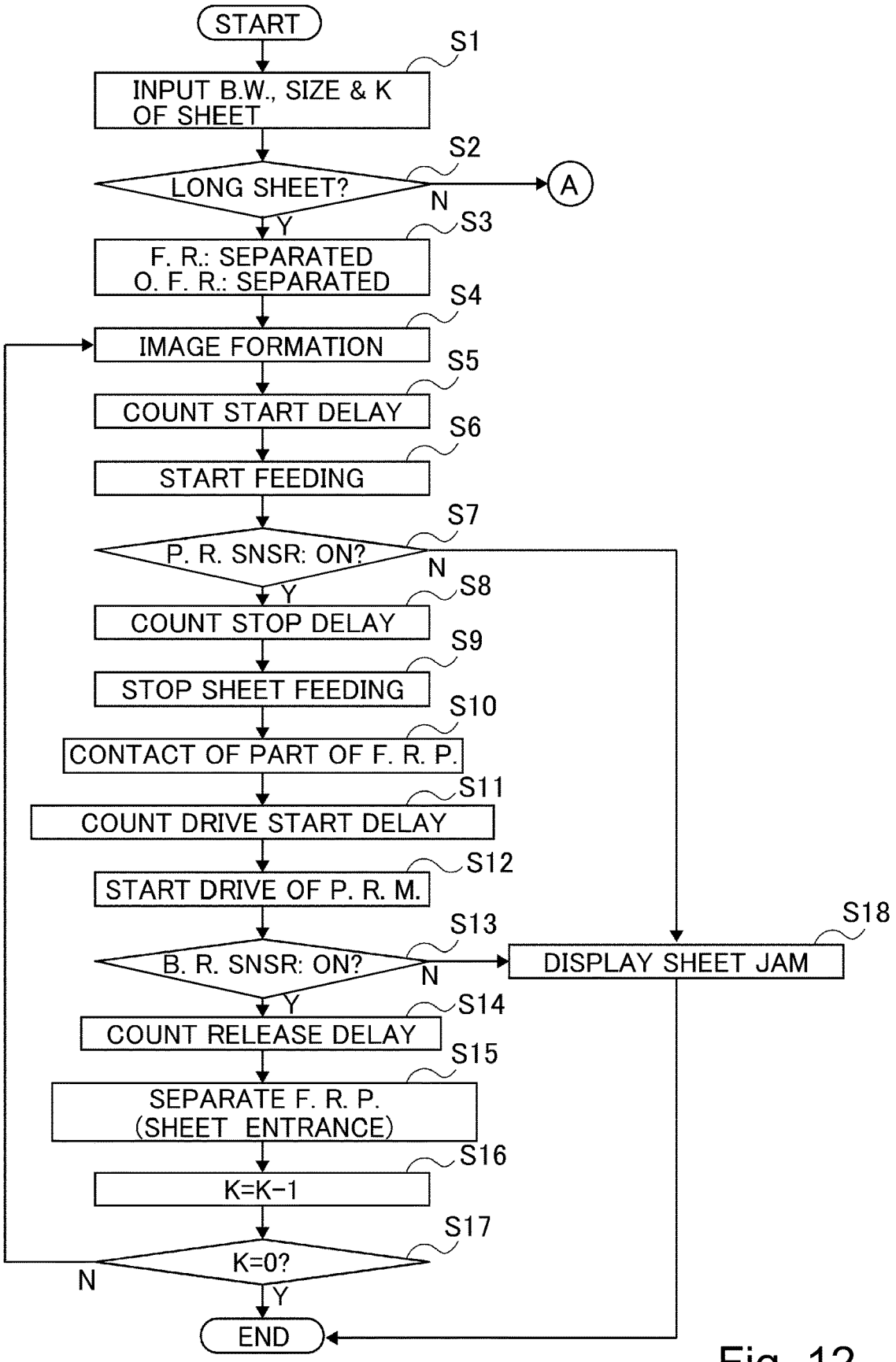

FIG. 12 is a flowchart showing feeding control of the sheet in the embodiment.

Figure 13:
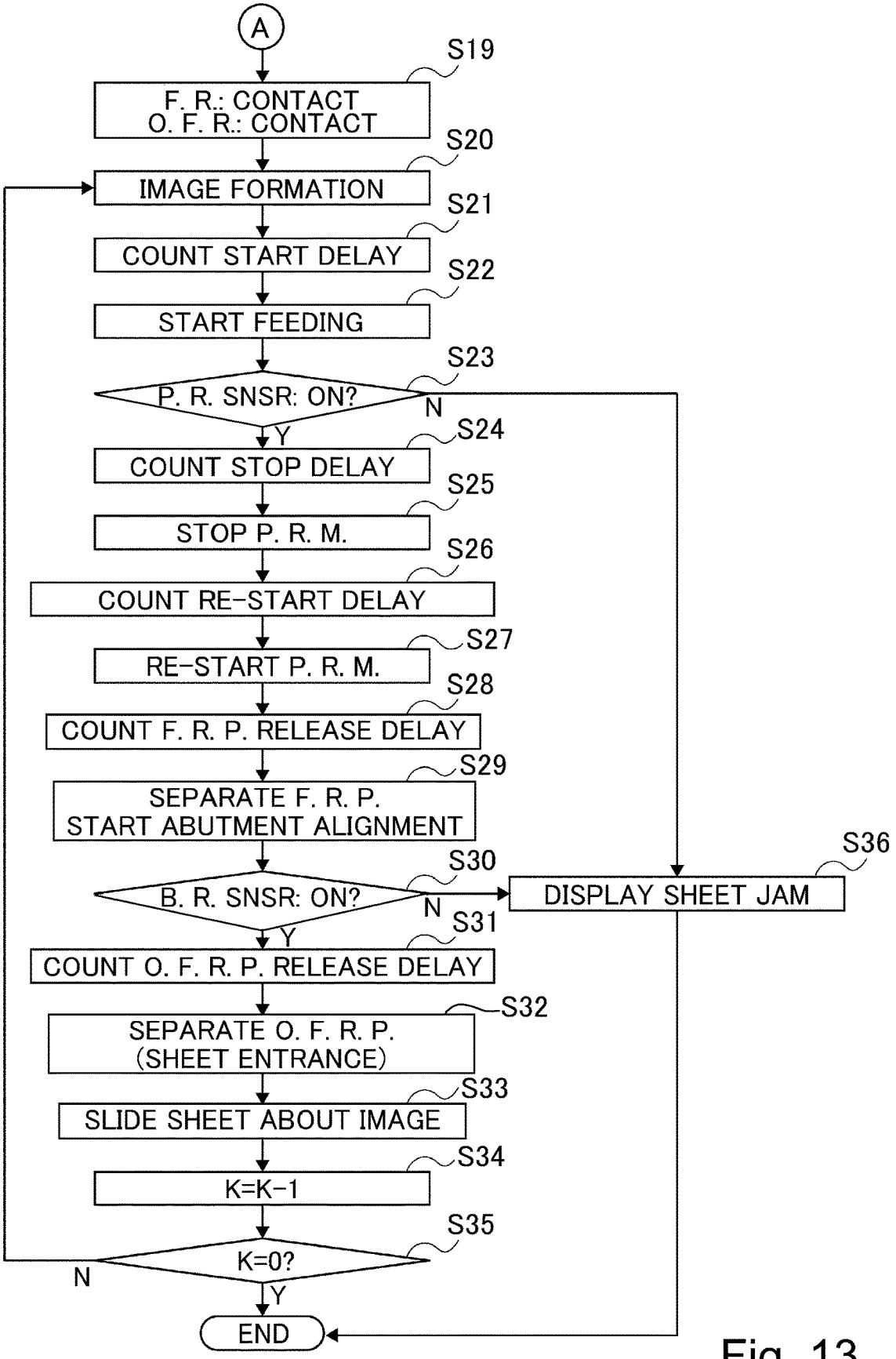

FIG. 13 is a flowchart showing feeding control of the sheet in the embodiment.

DESCRIPTION OF THE EMBODIMENTS

Embodiments of the present invention will be specifically described with reference to the drawings. Dimensions, materials, shapes and relative arrangement of constituent elements described in the following embodiments should be appropriately be changed depending on structures and various conditions of apparatuses (devices) to which the present invention is applied, and the scope of the present invention is not intended to the limited thereto.

[General Structure]

Figure 1:
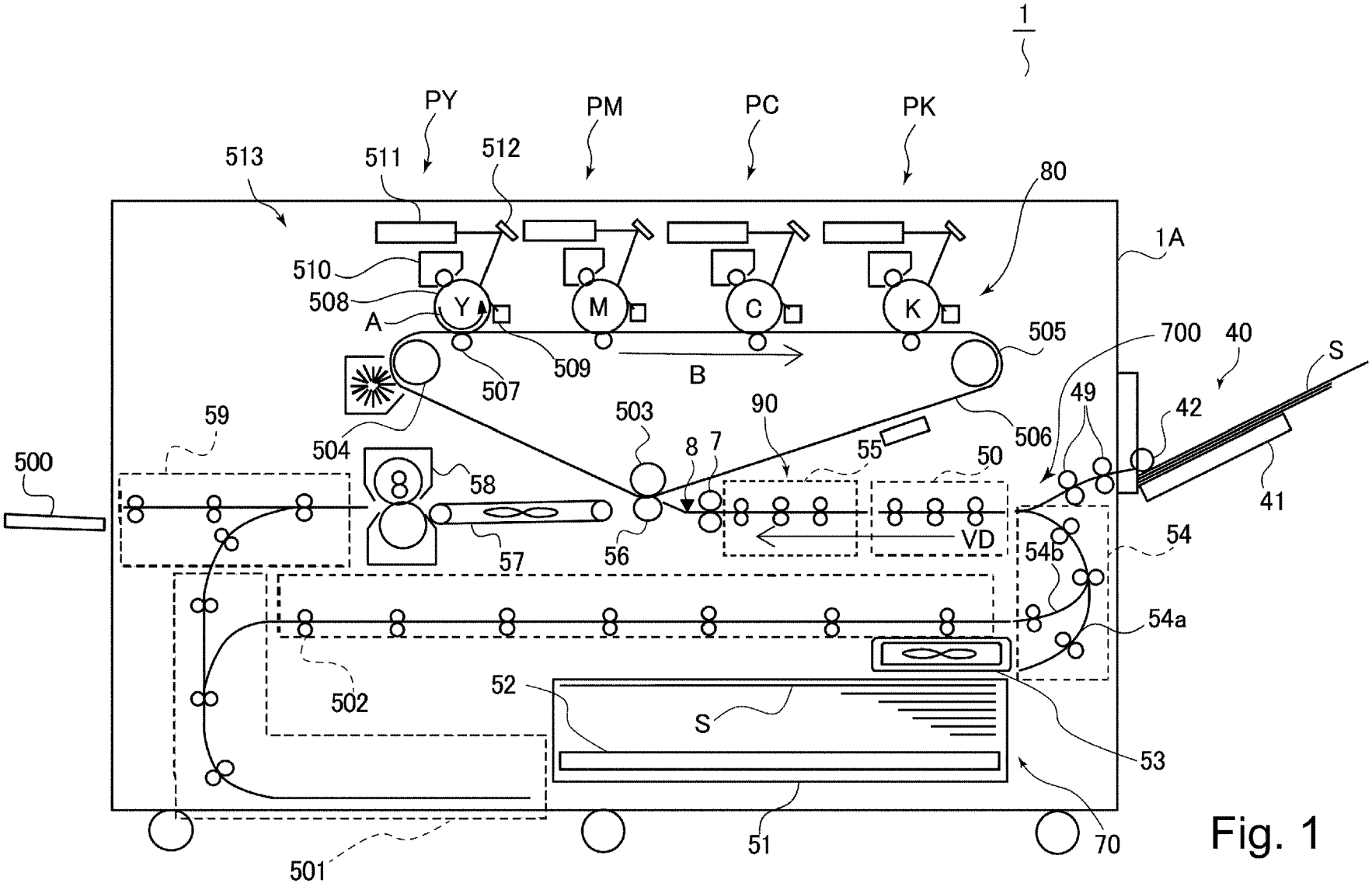
FIG. 1 is a sectional view showing entirety of an image forming apparatus in an embodiment of the present invention.

An image forming apparatus 1 in an embodiment of the present invention is a full-color laser (beam) printer of an intermediary tandem type in which an intermediary transfer belt 506 as shown in FIG. 1. The image forming apparatus 1 of this type does not need to hold a sheet on a transfer drum or a transfer belt, and therefore, it is possible to meet various transfer materials such as super-thick paper and coated paper, and in addition, the image forming apparatus 1 is suitable for realizing high productivity since the image forming apparatus 1 has advantages such as parallel processing in a plurality of image forming portions and collective transfer of color toner images for a full-color image.

The image forming apparatus 1 forms an image on a sheet P on the basis of an image signal inputted from an information terminal such as a personal computer or from an external device such as an image reader. The image forming apparatus 1 is capable of using, as a recording material (medium), various sheets including paper such as a form or an envelope, glossy paper, a plastic film such as an overhead projector (OHP) sheet, a cloth and the like.

The image forming apparatus 1 includes a sheet feeding (conveying) system described later and an image forming portion 80. The image forming portion 80 includes four process units PY, PM, PC and PK for forming toner images of yellow, magenta, cyan and black, respectively and the intermediary transfer belt 506 which is an intermediary transfer member. Each of the process units PY to PK is an electrophotographic unit including a photosensitive drum which is a photosensitive member.

The process units PY to PK are similarly constituted except that colors of toners used for development are different from each other, and therefore, a structure and a toner image forming process (image forming operation) of the process units will be described by using the process unit PY as an example. The process unit PY includes, in addition to a photosensitive drum 508, an unshown charging device, an exposure device 511, a developing device 510 and a drum cleaner 509. The photosensitive drum 508 is a drum-shaped photosensitive member including a photosensitive layer at an outer peripheral portion and rotates in an arrow A direction along a rotational direction of the intermediary transfer belt 506. A surface of the photosensitive drum 508 is electrically charged by being supplied with electric charges from the charging device 2.

The exposure device 511 emits laser light modulated depending on image information, so that the surface of the photosensitive drum 508 is scanned with the laser light appropriately through a diffraction means 512 or the like, and thus an electrostatic latent image is formed on the surface of the photosensitive drum 508. The developing device 510 accommodates a developer containing the toner and develops the electrostatic latent image into a toner image by supplying the toner to the surface of the photosensitive drum 508. The toner image formed on the photosensitive drum 508 is primary-transferred onto the intermediary transfer belt 506 at a primary transfer portion which is a nip between the intermediary transfer belt 506 and a primary transfer roller 507 which is a primary transfer device. Residual toner remaining on the photosensitive drum 508 after the transfer is removed by the drum cleaner 509.

The intermediary transfer belt 506 is extended and wound around a driving roller 504, a tension roller 505 and an inner secondary transfer roller 503 and the like, and is rotationally driven in an arrow B direction in FIG. 1 by the driving roller 504. The image forming operation described above is performed in the process units PY to PK in parallel, and the four color toner images are transferred so as to be superposed on each other, so that a full-color toner image is formed on the intermediary transfer belt 506. These toner images are fed to a secondary transfer portion by being carried on the intermediary transfer belt 506. The secondary transfer portion is constituted as a nip as a transfer portion between a secondary transfer roller 56 and the inner secondary transfer roller 503, and the toner image is secondary-transferred onto the sheet S under application of a bias voltage, to the secondary transfer roller 56, of a polarity opposite to a charge polarity of the toner. Residual toner remaining on the intermediary transfer belt 506 after the transfer is removed by a belt cleaner.

The sheet S on which the toner image is transferred is delivered to a fixing unit 58 by a pre-fixing feeding portion 57. The fixing unit 58 includes a fixing roller pair for feeding the sheet S while nipping the sheet S and a heat source such as a halogen heater, and applies heat and pressure to the toner image carried on the sheet S. By this, toner particles are melted and fixed, so that an image fixed on the sheet S is obtained.

Next, a structure and an operation of a sheet feeding system for feeding the sheet S and for discharging the sheet S, on which the image is formed, onto a discharge tray 500 will be described. The sheet feeding system roughly includes a cassette feeding portion 70, a merging feeding portion 54, a manual feeding device 40, a first feeding portion 50, a second feeding portion 55, a registration roller pair 7, a branch feeding portion 59, a reverse feeding portion 501 and a double-side feeding portion 502.

The cassette feeding portion 70 includes a feeding cassette 51 for accommodating sheets S, a sheet stacking portion 52 which is provided in the feeding cassette 51 and on which the sheets S are stacked, and a feeding device 53. The feeding device 53 not only attracts and separates an uppermost sheet stacked on the sheet stacking portion 52, by the air, but also feeds the uppermost sheet. Incidentally, the feeding device 53 is not limited to the feeding device 53 of such an air separation type but may also be of a type in which the sheet S is separated by an electrostatic force or of a friction separation type in which the sheet S is separated by a feeding roller or a separation roller or the like.

The sheet S fed by the feeding device 53 and the sheet S fed by the manual feeding device 40 described later are fed to the first feeding portion 50 through the merging feeding portion 54. Then, the sheet S fed in a sheet feeding direction VD by the first feeding portion 50 is subjected to correction of oblique movement in the second feeding portion 55, and then is fed to the registration roller pair 7. The registration roller pair 7 is capable of sliding the sheet S in a widthwise direction WD (see FIG. 2) perpendicular to the sheet feeding direction VD while nipping and conveying the sheet S. By this, a position of the sheet S with respect to the widthwise direction WD is corrected.

Then, the sheet S is fed by the registration roller pair 7 on the basis of detection timing thereof by a registration sensor 8 so as to be synchronized with transfer timing at the secondary transfer portion. The sheet S on which the toner image is transferred in the secondary transfer portion and on which the image is fixed by the fixing unit 58 is fed to the branch feeding portion 59 including an unshown switching member capable of switching a feeding passage of the sheet S. In the case where the image formation on the sheet S is completed, the sheet S is discharged onto the discharge tray 500.

In the case where the image is formed on a back surface (side) of the sheet P, the sheet P is delivered to the double-side feeding portion 502 through the reverse feeding portion 501. The reverse feeding portion 501 includes a reverse roller pair capable of being rotated normally and reversely and subjects the sheet S to switch-back, and then delivers the sheet S to the double-side feeding portion 502. The double-side feeding portion 502 feeds the sheet S toward the merging feeding portion 54 through a double-side feeding path 54*b* merging with a feeding path 54*a*. At the merging feeding portion 54, the feeding path 54*a* and the double-side feeding path 54*b* merge with each other. Then, the image is formed on the back surface of the sheet S, and then the sheet S is discharged onto the discharge tray 500.

Incidentally, a sheet feeding device 700 according to this embodiment includes the manual feeding device 40, the first feeding portion 50, the second feeding portion 55, the registration roller pair 7 and a controller 600 (see FIG. 7). Further, in addition to the above-described constitution, the image forming portion 80 is included, so that the image forming apparatus 1 may also be used as the sheet feeding device.

[Sheet Aligning Portion]

Figure 2:
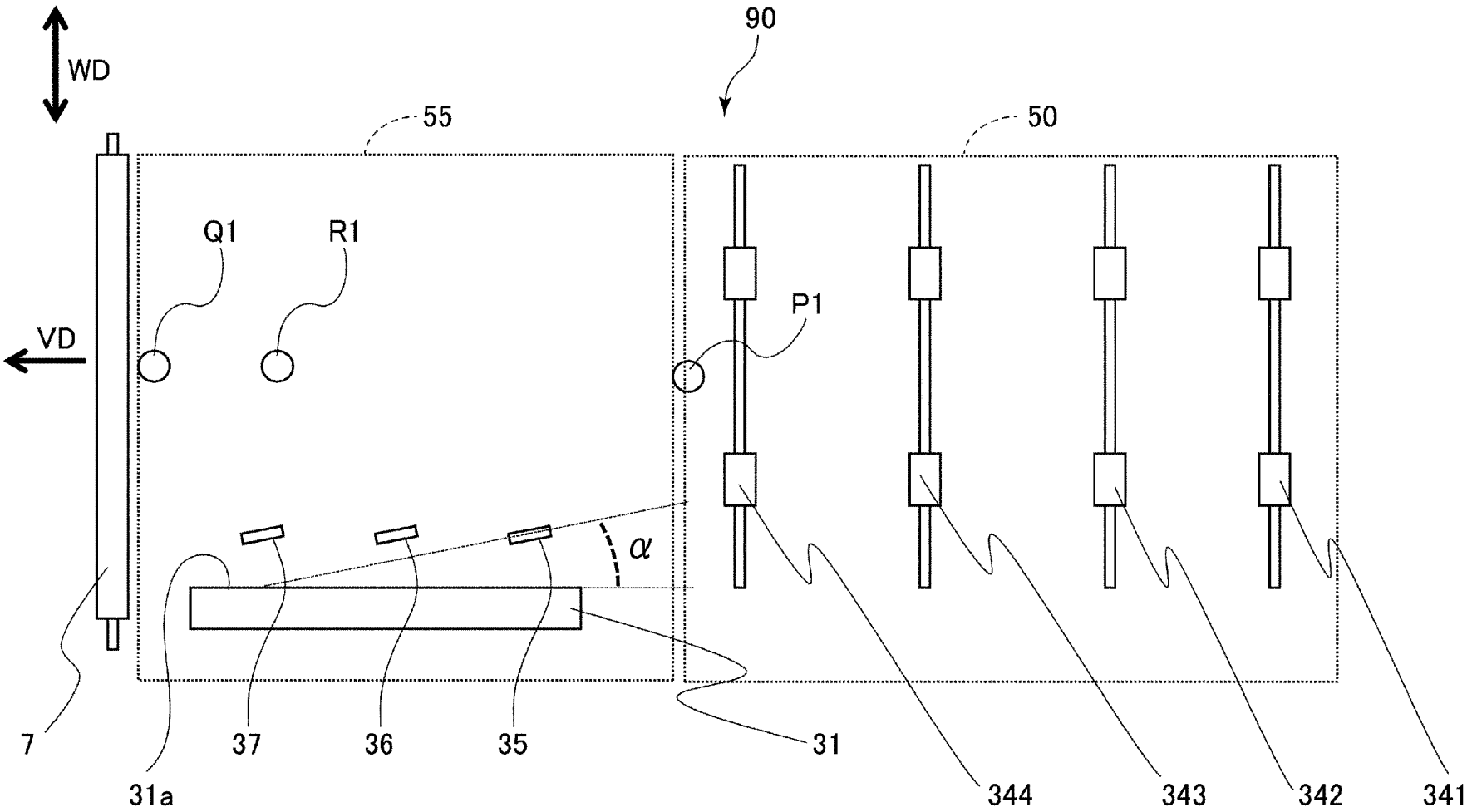
FIG. 2 is a (top) plan view showing a sheet alignment portion in the embodiment.

A sheet aligning portion 90 constituted by the first feeding portion 50, the second feeding portion 55 and the registration roller pair 7 and the like will be described. As shown in FIG. 2, with respect to the sheet feeding direction VD, the second feeding portion 55 is provided downstream of the first feeding portion 50, and the registration roller pair 7 as a second feeding roller pair is provided downstream of the second feeding portion 55.

The first feeding portion 50 includes feeding roller pairs 341, 342, 343 and 344, which are first feeding roller pairs, provided in a named order from an upstream side toward a downstream side with respect to the sheet feeding direction VD. The second feeding portion 55 includes a reference member 31 which is an abutment member extending along the sheet feeding direction VD, and includes three obliquely feeding rollers 35, 36 and 37 provided with intervals with respect to the sheet feeding direction VD.

A sheet feeding direction of the obliquely feeding rollers is inclined relative to a reference surface 31*a* of the reference member 31 by an angle α. Therefore, the obliquely feeding roller 35, 36 and 37 rotate in contact with the sheet S and impart a feeding force to the sheet S in a direction in which the sheet S is inclined so as to approach the reference surface 31*a* of the reference member 31 with respect to the widthwise direction WD as the sheet S is fed toward a downstream side of the sheet feeding direction VD.

The registration roller pair 7 is slidable in the widthwise direction WD in a state in which the registration roller pair 7 nips the sheet S, and moves the sheet S having a side end contacted to the reference surface 31*a* of the reference member 31 in the widthwise direction WD in conformity to a position of the image transferred in the secondary transfer portion. Incidentally, the reference member 31 is movable in the widthwise direction WD and is positioned in advance in conformity to a width of the sheet S fed. Further, a method in which positional adjustment of the sheet S and the image to be formed on the sheet S is not limited thereto, and for example, a constitution in which a position of the reference member 31 is fixed and positions, with respect to a main scan direction, of the toner images formed by the process units PY to PK are adjusted may also be employed.

At a downstream end portion of the first feeding portion 50 with respect to the sheet feeding direction VD, a pre-registration sensor P1 is provided. The pre-registration sensor P1 is disposed at a central portion of the feeding passage with respect to the widthwise direction WD. At a downstream end portion of the second feeding portion 55 with respect to the sheet feeding direction VD, an obliquely feeding sensor R1 and a before-registration sensor Q1 are provided. Each of the pre-registration sensor P1, the obliquely feeding sensor R1 and the before-registration sensor Q1 includes a light emitting portion and a light receiving portion. Then, when the sheet S passes through between the light emitting portion and the light receiving portion, light reflected by the sheet S is detected by the light receiving portion, so that passage timing of the sheet S is detected at each of detecting positions of these sensors.

[Peripheral Structure of Feeding Roller Pairs]

Next, a peripheral structure of the feeding roller pairs 341, 342, 343 and 344 of the first feeding portion 50 will be described. Each of the feeding roller pairs 341, 342, 343 and 344 is contacted and separated by a contact-and-separation mechanism. Further, the feeding roller pairs 341, 342, 343 and 344 and their contact-and-separation mechanisms have the same constitutes, and therefore, in the following, only the feeding roller pair 341 and the contact-and-separation mechanism thereof will be described.

Figure 3:
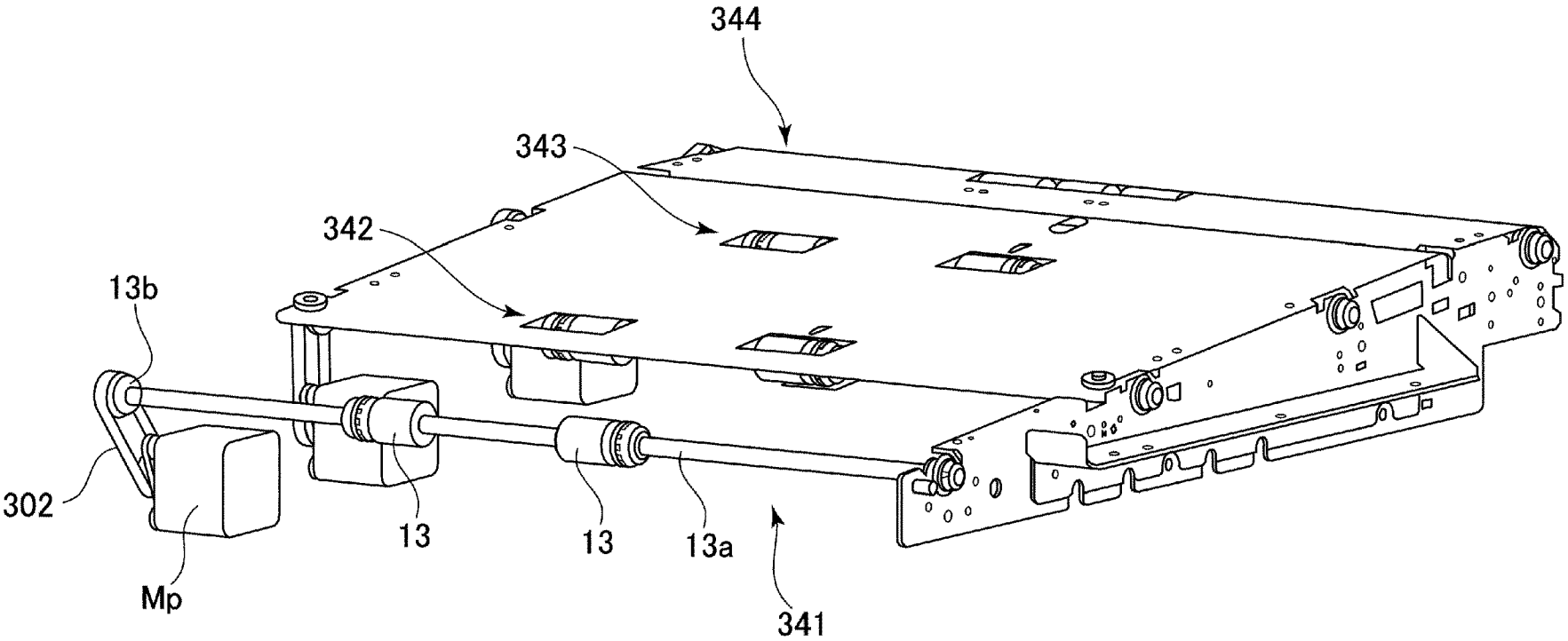
FIG. 3 is a perspective view showing a feeding roller pair and a peripheral structure thereof in the embodiment.

As shown in FIG. 3 and parts (a) and (b) of FIG. 4, the feeding roller pair 341 includes a driving roller 13 and a follower roller 14. The driving roller 13 is supported by a driving shaft 13*a* as shown in FIG. 3, and at an end portion of the driving shaft 13*a*, a pulley 13*b* is fixed. Around the pulley 13*b*, a belt 302 driven by a pre-registration motor Mp is wound, and the pre-registration motor Mp is driven, so that the driving roller 13 is driven.

The pre-registration motor Mp as a first driving potion is constituted by a stepping motor, and depending on a detection result of the pre-registration sensor P1, driving timing, (drive) stop timing and a driving speed of the pre-registration motor Mp are controlled. By this, driving timing, (drive) stop timing and a rotational speed (feeding speed) of the driving roller 13 are controlled.

The follower roller 14 of the feeding roller pair 341 is contacted to and separated from the driving roller 13 by a contact-and-separation mechanism 100 as shown in parts (a) and (b) of FIG. 4. The contact-and-separation mechanism 100 as a first contact-and-separation mechanism includes a nip releasing motor 104, gears 105 and 106, an eccentric cam 103 and an arm member 101. The nip releasing motor 104 is constituted by a stepping motor. The gear 105 is not only driven by the nip releasing motor 104 but also engaged with the gear 106.

The gear 106 is rotated integrally with the eccentric cam 103 by the gear 105. The arm member 101 is supported by a stay member 18, fixed to a frame of the image forming apparatus 1, so as to be swingable about a swing shaft 102. The arm member 101 includes one end portion 101*a* pressed by rotation of the eccentric cam 103 and the other end portion 101*b* supporting a rotation shaft 14*b* of the follower roller 14.

As shown in part (a) of FIG. 4, when the eccentric cam 103 is positioned in a first rotation position, the follower roller 14 is press-contacted to the driving roller 13 by an unshown spring. Thus, a nip N1 is formed by the driving roller 13 and the follower roller 14. Further, as shown in part (b) of FIG. 4, when the eccentric cam 103 is positioned in a second rotation position where the eccentric cam 103 is rotated 180° from the first rotation position, the one end portion 101*a* of the arm member 101 is pressed by a large-diameter portion of the eccentric cam 103, so that the other end portion 101*b* is swung upward. By this, the follower roller 14 is separated from the driving roller 13, so that the nip N1 is released.

Thus, the feeding roller pair 341 is capable of being changed in state by the contact-and-separation mechanism 100 between a feedable state (contact state) in which the driving roller 13 and the follower roller 14 which are two rollers constituting the feeding roller pair 341 are capable of feeding the sheet S while nipping the sheet S and a spaced state in which the driving roller 13 and the follower roller 14 are in separation from each other. The nip releasing motor 104 is driven depending on a detection result of the pre-registration sensor P1, so that the feeding roller pair 341 is changed between the contact state and the spaced state.

For example, in the case where a shifting operation by the obliquely feeding rollers 35, 36 and 37 is started, all the feeding roller pairs 341, 342, 343 and 344 are in the spaced state when the trailing end portion of the sheet S does not pass through the nips. By this, it becomes possible to not only prevent obstruction of the sheet shifting operation by the feeding roller pairs 341, 342, 343 and 344 but also avoid occurrence of damage of the sheet due to friction or stress on the sheet S.

[Peripheral Structure of Obliquely Feeding Rollers]

Next, a peripheral structure of the obliquely feeding rollers 35, 36 and 37 will be described. As shown in FIGS. 2 and 5, the obliquely feeding roller 35 is rotated about a rotation shaft 35*d* and is supported by a rotation shaft 325*a* through a universal joint 325. The obliquely feeding roller 36 is rotated about a rotation shaft 36*d* and is supported by a rotation shaft 326*a* through a universal joint 326. The obliquely feeding roller 37 is rotated about a rotation shaft 37*d* and is supported by a rotation shaft 327*a* through a universal joint 327.

The rotation shafts 35*d*, 36*d* and 37*d* extend in directions crossing the sheet feeding direction VD in which the sheet is fed along the feeding passage and the widthwise direction WD perpendicular to the sheet feeding direction VD. Further, the sheet feeding direction of the obliquely feeding rollers 35, 36 and 37 is inclined by the angle α relative to the reference surface 31*a* of the reference member 31 by the universal joints 325, 326 and 327, respectively.

To the rotation shaft 325*a*, a pulley 325*b* is fixed, and to the rotation shaft 326*a*, pulleys 326*b* and 326*c* are fixed. Abound the pulleys 326*b* and 326*c*, belts 321 and 322 are wound, respectively, and these belts 321 and 322 are driven by an obliquely feeding (roller) driving motor Ms as a second driving portion. To the rotation shaft 327*a*, a pulley 327*b* is fixed, and around the pulleys 326*b* and 327*b*, the belt 323 is wound. By employing such a constitution, the obliquely feeding driving motor Ms is driven, so that the obliquely feeding rollers 35, 36 and 37 are driven.

As shown in parts (a) and (b) of FIG. 6, in the second feeding portion 55, an obliquely feeding roller pair is constituted by each of the obliquely feeding rollers 35, 36 and 37 and its corresponding follower roller, and a contact-and-separation mechanism for contacting the follower roller to the obliquely feeding roller and for separating the follower roller from the obliquely feeding roller is provided. These follower roller and contact-and-separation mechanism are provided corresponding to the number of the obliquely feeding rollers. For this reason, in the following, a follower roller 331 and a contact-and-separation mechanism 200 which correspond to the obliquely feeding roller 35 will be described, and other follower rollers and their associated contact-and-separation mechanisms will be omitted from description.

The contact-and-separation mechanism 200 as a second contact-and-separation mechanism includes an arm member 332, a link member 333, a pressing gear 334, a pressing spring 335, and an obliquely feeding (roller) pressing motor Mk. The follower roller 331 as a nipping roller is rotatably supported by the arm member 332 and is movable in a direction in which the follower roller 331 approaches the obliquely feeding roller 35 or is separated from the obliquely feeding roller 35 by swing of the arm member 332 about a swinging shaft 332*a*. Thus, the follower roller 331 is constituted so s to be changeable in state between a feedable state in which the follower roller is capable of feeding the sheet S in cooperation with the obliquely feeding roller 35 while nipping the sheet S therebetween and a spaced state in which the follower roller 331 is separated from the obliquely feeding roller 35.

The follower roller 331 in this embodiment is rotated along the sheet feeding direction about an axis extending in the widthwise direction WD, but a constitution in which the follower roller 331 is disposed on an axis parallel to its corresponding obliquely feeding roller 35 may also be employed. The arm member 332 is connected to the pressing gear 334 through the pressing spring 335 and the link member 333. The pressing gear 334 is driven by the obliquely feeding pressing motor Mk which is a driving source.

As shown in part (a) of FIG. 6, when the pressing gear 334 is rotated in the counterclockwise direction in the figure, the arm member 332 pulled by the pressing spring 335 is swung about the swung shaft 332*a* in the counterclockwise direction. By this, a press-contact state in which the follower roller 331 is press-contacted to the obliquely feeding roller 35 is formed. On the other hand, as shown in part (b) of FIG. 6, when the pressing gear 334 is rotated in the clockwise direction in the figure and presses the link member 333, the link member 332 swings the arm member 322 in the clockwise direction. By this, the follower roller 331 is separated from the obliquely feeding roller 35, or at least a spaced state in which a contact pressure of the follower roller 331 to the obliquely feeding roller 35 is smaller than a contact pressure in the press-contact state is formed.

The obliquely feeding pressing motor Mk is a stepping motor, and by controlling an angle of rotation of the pressing gear 334, an elongation amount of the pressing spring 335 in the press-contact state is capable of being changed. That is, the contact-and-separation mechanism 200 in this embodiment is capable of carrying out both a change between the press-contact state and the spaced state and a change in pressure in the press-contact state.

[Control System]

Next, a control system of the sheet aligning portion 90 will be described. As shown in FIG. 7, the sheet aligning portion 90 is controlled by a controller 600 as a control portion mounted in the image forming apparatus 1. The controller 600 includes a CPU 600*a*, a ROM 600*b* for storing various programs, and a RAM 600*c* used as a work space for the CPU 600*a*.

To the controller 600, an operating portion 412 including an operating panel and physical buttons is connected, and a user is capable of changing various settings of the image forming apparatus 1 and of providing an instruction of a job through the operating portion 412.

Further, to the controller 600, the registration sensor 8, the obliquely feeding sensor R1, the pre-registration sensor P1, the before-registration sensor Q1, the pre-registration motor Ms, the obliquely feeding driving motor Ms, the obliquely feeding pressing motor Mk, the nip releasing motor 104 and the like are connected.

[Manual Feeding Device]

Next, the manual feeding device 40 will be specifically described. As shown in FIG. 8, the manual feeding device 40 includes a sheet supporting portion 41 for supporting the sheet S and a feeding portion 429. The feeding portion 429 includes a feeding roller 42 for feeding the sheet S supported by the sheet supporting portion 41, and a drawing roller pair 49 provided downstream of the feeding roller 42 with respect to the sheet feeding direction VD and for feeding the sheet S fed by the feeding roller 42. Incidentally, in this embodiment, two drawing roller pairs 49 are provided, but a single drawing roller pair 49 or three or more drawing roller pairs 49 may also be provided. Further, the drawing roller pair 49 is provided so that the nip cannot be released, and there is no constitution in which the drawing roller pair 49 is contacted and separated.

The sheet supporting portion 41 is provided with a pair of first side regulating plates 48 as shown in FIGS. 9 to 11. This pair of first side regulating plates 48 is movable in the widthwise direction WD along guiding grooves 48*a* provided in the sheet feeding portion 41 and extending in the widthwise direction WD.

Further, a rotation shaft 46 extending in the widthwise direction WD is supported by the sheet supporting portion 41, and a mounting plate 45 is fixed to the rotation shaft 46. The rotation shaft 46 is fixed at an arbitrary rotation position by a fixing portion provided at one end with respect to the widthwise direction WD. The mounting plate 45 is provided with a pair of second side regulating plates 43. The pair of second side regulating plates 43 as a side end regulating portion is movable in the widthwise direction along guiding grooves 43 a provided in the mounting plate 45 and extending in the widthwise direction WD. Further, the pair of second side regulating plates 43 is fixed to the mounting plate 45 by fixing screws 44, and thus is positioned with respect to the widthwise direction WD.

These pair of first side regulating plates 48 and pair of second side regulating plates 43 are positioned in positions depending on a size of the sheet S supported by the sheet supporting portion 41, so that the position of the sheet S with respect to the widthwise direction WD is regulated (aligned). The first side regulating plates 48 and the second side regulating plates 43 have sufficient lengths in the sheet feeding direction VD, and therefore, oblique movement of the sheet S fed is satisfactorily restricted. Further, the second side regulating plates 43 is capable of adjusting the position of the sheet S with respect to the rotational direction about the rotation shaft 46 as an axis by adjusting a mounting angle of the mounting plate 45, so that positional deviation of the sheet S in the image forming apparatus 1 can be corrected.

In the case where a long sheet (elongated sheet) which is long with respect to the sheet feeding direction VD is fed, even when the sheet reaches the second feeding portion 55, a trailing end of the sheet is still positioned on the sheet supporting portion 41 in some instances. In this case, in the second feeding portion 55, even when the sheet is intended to be shifted to the reference member 31 by the obliquely feeding rollers 35, 36 and 37, the first side regulating plates 48 and the second side regulating plates 43 obstruct feeding of the sheet, so that the oblique movement of the sheet is rather promoted. For this reason, in this embodiment, in the case where the elongated sheet is fed, the shift of the sheet by the second feeding portion 55 is not carried out, and in a state in which all the obliquely feeding rollers 35, 36 and 37 are in the spaced state, control of feeding the elongated sheet is carried out.

Further, even in the case where the obliquely feeding rollers 35, 36 and 37 are in the spaced state, when the obliquely feeding rollers 35, 36 and 37 on the feeding passage are still rotated, the sheet receives a component of a force by which the sheet is moved toward the reference member 31, so that the oblique movement occurs. For this reason, in this embodiment, the sheet feeding is carried out while stopping the drive of the obliquely feeding rollers 35, 36 and 37.

[Sheet Feeding Control]

Next, feeding control of the sheet will be described along flowcharts of FIGS. 12 and 13. In FIGS. 12 and 13, "Y" represents YES, and "N" represents NO.

When an image forming job is started in a state in which pieces of information such as a boss weight, a size, the number of sheets and the like of the sheet are inputted (step S1), the controller 600 discriminates whether or not the sheet is the elongated sheet on the basis of sheet length discrimination control set in advance (step S2). In this embodiment, for example, the sheet is discriminated as the elongated sheet in the case where a sheet length set by the operating portion 412 is longer than a distance, with respect to the sheet feeding direction VD, from the drawing roller pair 49 which is a most downstream roller of the feeding portion 429 to the obliquely feeding roller 35. Further, for example, the sheet is discriminated as the elongated sheet in the case where the sheet length is longer than a distance, with respect to the sheet feeding direction VD, from a downstream end 43*b* (see FIG. 1) of the second side regulating plate 43 to the obliquely feeding roller 35.

Then, in the case where the sheet is discriminated as the elongated sheet (step S2: Y), the controller 600 executes an operation in an elongated sheet feeding mode as a mode including steps S3 to S18. Further, in the case where discrimination that the sheet is not the elongated sheet is made (step S2: N), the controller 600 executes an operation in a normal sheet feeding mode including the steps S19 to S36.

First, the operation in the elongated sheet feeding mode will be described. As shown in FIG. 12, the controller 600 controls the contact-and-separation mechanisms 100 and 200 so that all the feeding roller pairs 341 to 344 and all the obliquely feeding rollers 35 to 37 are put in the spaced states (step S3). Then, the controller 600 starts an image forming operation by the image forming portion 80 (step S4). Then, the controller 600 counts a feeding start delay time on the basis of start timing of the image forming operation (step S5), and then executes a feeding process for feeding process for feeding the sheet S by the feeding portion (step S6).

Incidentally, in this embodiment, the sheet S is fed by the feeding roller 42 and the drawing roller pair 49 of the feeding portion 419. Further, a first feeding motor for driving the feeding roller 42 and a second feeding motor for driving the drawing roller pair 49 are separately provided, and when the feeding of the sheet S is started, the first feeding motor and the second feeding motor are driven. When a leading end of the sheet reaches the drawing roller pair 49, the drive of the first feeding motor is stopped. During the feeding of the sheet, drive of the pre-registration motor Mp and drive of the obliquely feeding driving motor Ms are stopped, and therefore, the sheet S is fed to a stop position only by the drawing roller pair 49.

Here, since a distance between the pair of first side regulating plates 48 and the pair of second side regulating plates 43 which are provided on the sheet supporting portion 41 is short, the drawing roller pair 49 as a downstream feeding roller pair is capable of feeding the sheet while rectifying the oblique movement of the sheet by the second side regulating plates 43. On the other hand, the feeding roller pairs 341 to 344 and the obliquely feeding rollers 35 to 37 can constitute a factor causing the oblique movement of the sheet due to, for example, a variation in alignment since the distance between the pair of first side regulating plates 48 and the pair of second side regulating plates 43 is long. However, all the feeding roller pairs 341 to 344 and all the obliquely feeding rollers 35 to 37 are not only put in the spaced states but also drive-stopped, and therefore, the oblique movement of the sheet is not caused to occur. Incidentally, a constitution in which the feeding roller 42 and the drawing roller pair 49 are driven by a single motor may also be employed.

Further, the controller 600 discriminates whether or not the pre-registration sensor P1 is turned on (step S7). A state of the pre-registration sensor P1 is changed from an OFF state to an ON state by arrival of the sheet S at a detecting position of the pre-registration sensor P1. In the case where the pre-registration sensor P1 is turned on (step S7: Y), a stop delay time is counted (step S8), and then the controller 600 executes a stop process for stopping the feeding of the sheet S at a stop position (step S9). The stop of the feeding of the sheet S is carried out by stopping the drive of the drawing roller pair 49. Further, the leading end of the sheet S positioned in the stop position is in a position downstream of the feeding portion 429 and upstream of the registration roller pair 7 with respect to the sheet feeding direction VD. Specifically, the leading end of the sheet S positioned in the stop position is in a position downstream of the drawing roller pair 49 and upstream of the registration roller pair 7 with respect to the sheet feeding direction VD.

Incidentally, in the case where the pre-registration sensor p1 does not detect the sheet S even when a predetermined time has elapsed from the start of the feeding, a screen showing a sheet jam is displayed on the operating portion 412 (step S18), and execution of the job is ended.

After the step S9, in a state in which the sheet S is at rest, the controller 600 executes a contact process in which the controller 600 controls the contact-and-separation mechanism 100 so that at least one of the feeding roller pairs 341 to 344 which are a plurality of roller pairs is changed in state from the spaced state to the contact state (step S10). In this embodiment, of the four pairs of feeding roller pairs 341 to 344, two feeding roller pairs 342 and 344 are changed in state from the spaced state to the contact state.

Then, the controller 600 counts a drive start delay time in conformity to progression of the image forming operation (step S11), and then starts the drive of the pre-registration motor Mp (step S12). At this time, it is sufficient that the pre-registration motor Mp for driving the feeding roller pairs 342 and 344 put in the contact state, but the pre-registration motors Mp for driving the feeding roller pairs 341 and 343 still put in the spaced state may also be driven. A feeding process for feeding the sheet S to the registration roller pair 7 is executed by the feeding roller pairs 342 and 344 put in the contact state. The drive start timing of the pre-registration motor Mp is adjusted in conformity to the image forming operation, so that a variation in time until the sheet S reaches the pre-registration sensor P1 is absorbed.

Thereafter, the controller 600 discriminates whether or not the before-registration sensor Q1 is turned on (step S13). The before-registration sensor Q1 is changed in state from an OFF state to an ON state by arrival of the sheet S at a detecting position thereof. In the case where discrimination that the before-registration sensor Q1 is turned on (step S13: Y), a delay time for releasing contact (pressing) of each of the feeding roller pairs 342 and 344 is counted (step S14), so that the feeding roller pairs 342 and 344 are put in the spaced states. Incidentally, in the case where the before-registration sensor Q1 does not detect the sheet S in a predetermined time, the screen showing the sheet jam is displayed at the operating portion (step S18), and then execution of the job is ended.

When the sheet S is sent to the secondary transfer portion, by a counter for managing the number K of remaining sheets S to be subjected to image formation, a value of the number K is decremented (step S16). In the case where the number K of remaining sheets S is not 0, i.e., in the case where the sheets to be subjected to image formation remain (step S17: N), the above-described operation (steps S4 to S17) is repeated. In the case where the number K of remaining sheets S is 0 (step S17: Y), discrimination that the image forming operation is completed is made, so that execution of the job is ended.

Next, an operation in a normal feeding mode will be described. As shown in FIG. 12, the controller 600 controls the contact-and-separation mechanisms 100 and 200 so that all the feeding roller pairs 341 to 344 and all the obliquely feeding rollers 35 to 37 are put in the contact states (step S19). Then, the controller 600 starts an image forming operation by the image forming portion 80 (step S20). Then, the controller 600 counts a feeding start delay time on the basis of start timing of the image forming operation (step S21), and then the sheet S is fed by the feeding portion (step S22).

In the operation in the normal sheet feeding mode, during the sheet feeding, the pre-registration motor Mp is driven, but the drive of the obliquely feeding driving motor Ms is at rest. For this reason, the sheet S is fed to a stop position by the drawing roller pair 49 of the feeding portion 429 and by the feeding roller pairs 341 to 344.

Then, the controller 600 discriminates whether or not the pre-registration sensor P1 is turned on (step S23). In the case where the pre-registration sensor P1 is turned on (step S23: Y), a stop delay time is counted (step S24), and then the feeding of the sheet S is stopped (step S25). The stop of the feeding of the sheet S is carried out by stopping the drive of an unshown second feeding motor and the pre-registration motor Mp and thus by stopping the drive of the drawing roller pair 49 and the feeding roller pairs 341 to 344.

Incidentally, in the case where the pre-registration sensor p1 does not detect the sheet S even when a predetermined time has elapsed from the start of the feeding, a screen showing a sheet jam is displayed on the operating portion 412 (step S36), and execution of the job is ended.

After the step S25, the controller 600 counts a re-start delay time in conformity to progression of the image forming operation (step S26), and then resumes the drive of the pre-registration motor Mp (step S27). At this time, the obliquely feeding driving motor Ms is also driven, so that the obliquely feeding rollers 35 to 37 are driven. Thereafter, the controller 600 counts a delay time for releasing contact (pressing) of each of the feeding roller pairs 341 to 344 (step S28), and changes the state of the feeding roller pairs 341 to 344 to the spaced state (step S29).

By this, an abutment aligning operation for correcting the oblique movement of the sheet S by causing the sheet S to abut against the reference member 31 is started. The abutment aligning operation in the flowchart of FIG. 13 is performed in a period (steps S29 to S32) from the release of the pressing of each of the feeding roller pairs 341 to 344 until the obliquely feeding rollers 35 to 37 are put in the spaced state.

When the pressing of each of the feeding roller pairs 341 to 344 is released, as shown in FIG. 2, the sheet S starts oblique movement relative to the sheet feeding direction VD so as to approach the reference member 31 by a feeding force received from the second feeding portion 55 as shown in FIG. 2. That is, the sheet S is obliquely fed along a tangential direction of each of the obliquely feeding rollers 35 to 37 inclined relative to the sheet feeding direction VD and thus is shifted toward the reference surface 31*a* of the reference member 31. Then, the sheet S further approaches the reference member 31, so that a side end thereof contacts the reference surface 31*a*. By this, the side end of the sheet S is caused to follow the reference surface 31*a* in the case where the side end of the sheet S is inclined with respect to the sheet feeding direction VD, so that the oblique movement of the sheet S is corrected. Incidentally, an actual sheet movement direction does not always coincide with the obliquely feeding roller tangential direction since a slip of the obliquely feeding rollers occur due to the influences such as inertia of the sheet and a feeding resistance exerted on the sheet.

Thereafter, the controller 600 discriminates whether or not the before-registration sensor Q1 is turned on (step S30). In the case where discrimination that the before-registration sensor Q1 is turned on (step S30: Y), a delay time for releasing contact (pressing) of each of the obliquely feeding rollers 35 to 37 is counted (step S31), so that the contact of each of the obliquely feeding rollers 35 to 37 is released and the obliquely feeding rollers 35 to 37 are put in the spaced states. This delay time is set so that the obliquely feeding rollers 35 to 37 are put in the spaced state after the leading end of the sheet S enters the nip of the registration roller pair 7. Incidentally, in the case where the before-registration sensor Q1 does not detect the sheet S in a predetermined time, the screen showing the sheet jam is displayed at the operating portion 412 (step S36), and then execution of the job is ended.

After the step S36, when the sheet S is delivered to the registration roller pair 7, as shown in FIG. 2, the registration roller pair 7 moves in the widthwise direction WD while feeding the sheet S. By this, a center position of the sheet S with respect to the widthwise direction WD is positionally aligned in conformity to a center position of the images formed by the process units PY to PK (step S33).

When the sheet S is sent to the secondary transfer portion, by a counter for managing the number K of remaining sheets S to be subjected to image formation, a value of the number K is decremented (step S34). In the case where the number K of remaining sheets S is not 0, i.e., in the case where the sheets to be subjected to image formation remain (step S35: N), the above-described operation (steps S20 to S35) is repeated. In the case where the number K of remaining sheets S is 0 (step S35: Y) discrimination that the image forming operation is completed is made, so that execution of the job is ended.

As described above, in this embodiment, the above-described operation in the elongated sheet feeding mode can be executed. In the operation in the elongated sheet feeding mode, the sheet S is not fed by the feeding roller pairs 341 to 344 of the first feeding portion 50 and by the obliquely feeding rollers 35 to 37 of the second feeding portion 55, but is fed to the stop position by the drawing roller pair 49. These feeding roller pairs 341 to 344 and obliquely feeding rollers 35 to 37 are in the spaced states and the drive-stop states.

In other words, at least in a period from the start of the feeding process (step S6) until the feeding process (step S12) is ended, not only the state in which the obliquely feeding roller 35 is separated from the follower roller 331 is maintained but also the drive of the obliquely feeding driving motor Ms is stopped. Further, at least in a period from the start of the feeding process (step S6) until the contact process (step S10) is ended, the drive of the pre-registration motor Mp is stopped. Then, in the feeding process (step S12), the pre-registration motor Mp is driven so that the feeding roller pairs 342 and 344, which are put in the contact state, of the feeding roller pairs 341 to 344 are driven.

For this reason, even when the feeding roller pairs 341 to 344 cannot be disposed in parallel to the registration roller pair 7 due to an alignment deviation and part tolerance, there is no influence of inclination (oblique movement) of the sheet S. Further, a component of a force toward the sheet feeding direction is not imparted to the sheet S by the obliquely feeding rollers 35 to 37, so that a degree of the oblique movement of the sheet S can be reduced.

Then, the sheet S stopped at the stop position is nipped by the feeding roller pairs 342 and 344 which are a part of the feeding roller pairs 341 to 344 and then is fed toward the registration roller pair 7. At this time, the elongated sheet S is not subjected to abutment alignment at the second feeding portion 55, but is subjected to alignment with respect to the widthwise direction WD by the pair of first side regulating plates 48 and the pair of second side regulating plates 43, and therefore, it is possible to reduce the degree of the oblique movement of the sheet S.

Further, in the case of the elongated sheet, due to a large sheet size, a feeding resistance when the feeding of the sheet S is resumed (step S11) is particularly large, and therefore, a feeding force necessary to accelerate the sheet S is large, so that improper feeding of the sheet S is liable to occur. Here, for example, when in consideration of the alignment deviation or the like of the feeding roller pairs 341 to 344, all the feeding roller pairs 341 to 344 are put in the spaced state and the drive-stopped state and the feeding of the sheet S is resumed only by the drawing roller pair 49, the feeding force is insufficient in some cases. In this embodiment, the feeding roller pairs 342 and 344 are put in the contact state, and the sheet S is fed by the feeding roller pairs 342 and 344, and therefore, a degree of improper feeding of the sheet S, such as non-feeding or the like of the sheet S due to insufficient feeding force can be reduced. Incidentally, the sheet S may also be fed by not only the feeding roller pairs 342 and 344 put in the contact state but also the drawing roller pair 49.

Other Embodiments

In this embodiment, the four feeding roller pairs were provided in the first feeding portion 50, and the three obliquely feeding rollers were provided in the second feeding portion 55, but the present invention is not limited thereto. The first feeding portion 50 may only be required to be provided with two or more feeding roller pairs, and the second feeding portion 55 may only be required to be provided with one or more obliquely feeding rollers.

Further, in this embodiment, in the contact process shown in the step S10, the feeding roller pairs 342 and 344 were changed in state to the contact state, but the present invention is not limited thereto. That is, at least one of the feeding roller pairs 341 to 344 may only be required to be changed in state to the contact state, and for example, all the feeding roller pairs 341 to 344 may also be changed in state to the contact state. Incidentally, depending on an attitude of the sheet S fed, the number of the feeding roller pairs 341 to 344 of which states are changed to the contact state in the above-described contact process may also be changed. The attitude of the sheet S contains, for example, information on the basis weight, the size, a kind (coated paper, non-coated paper or the like), and so on. For example, when a sheet S with a first basis weight is fed, only a first number (for example, one) of roller pairs of the feeding roller pairs 341 to 344 may also be changed in state to the contact state in the contact process. Further, when a sheet S with a second basis weight larger than the first basis weight is fed, a second number (for example, three), more than the first number, of roller pairs of the feeding roller pairs 341 to 344 may also be changed in state to the contact state in the contact process. For example, when a sheet S with a first size is fed, only a first number (for example, one) of roller pairs of the feeding roller pairs 3341 to 344 may also be changed in state to the contact state in the contact process. Further, when a sheet S with a second size larger than the first size is fed, a second number (for example, three), more than the first number, of roller pairs of the feeding roller pairs 341 to 344 may also be changed in state to the contact state in the contact process.

Further, in this embodiment, the registration roller pairs 7 capable of being slid (moved) in the widthwise direction WD while nipping the sheet S was provided, but the present invention is not limited thereto. For example, the registration roller pair 7 may also be constituted so that the registration roller pair 7 is not capable of being slid (moved) in the widthwise direction WD although the registration roller pair 7 feeds the sheet S in synchronism with image formation timing.

Further, in this embodiment, the contact-and-separation mechanism 200 was constituted so that the follower roller 331 is capable of being contacted to and separated from the obliquely feeding roller 35 was employed, but the present invention is not limited thereto. That is, the contact-and-separation mechanism 200 may only be required to be constituted so that at least either one of the obliquely feeding roller 35 and the follower roller 331 is contacted to and separated from the other roller. Further, the obliquely feeding driving motor Ms driven the obliquely feeding roller 35 but may only be required to drive at least either one of the obliquely feeding roller 35 and the follower roller 331.

Further, in this embodiment, in the operation in the elongated sheet feeding mode, in the period until the contact process (step S10) is ended, the drive of the pre-registration motor Mp was stopped, but the present invention is not limited thereto. For example, in a period from a start of the feeding process (step S6) to a start of the contact process (step S12), the pre-registration motor Mp may also be driven.

Further, in either one of the above-described embodiments, the image forming apparatus 1 of the electrophotographic type was described, but the present invention is not limited thereto. For example, the present invention is also applicable to an image forming apparatus of an ink jet type in which an image is formed on a sheet by ejecting an ink liquid through nozzles.

The present invention is also capable of being realized in a process in which a program for realizing one or more functions in the above-described embodiments is supplied to a system or an apparatus through a network or a recording medium and then one or more processors in a computer of the system or the apparatus reads and executes the program. Further, the present invention is also capable of being realized by a circuit (for example, ASIC) realizing one or more functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-054355 filed on Mar. 25, 2020, which is hereby incorporated by reference herein in its entirety.

What is claimed is:

1. A sheet feeding device comprising:

a sheet supporting portion configured to support a sheet;

a side end regulating portion configured to regulate a side end of the sheet supported by said sheet supporting portion;

a feeding portion configured to feed the sheet supported by said supporting portion;

a first feeding roller pair configured to feed the sheet fed by said feeding portion, in a sheet feeding direction;

an abutment member which is provided downstream of said first feeding roller pair with respect to the sheet feeding direction, which extends in the sheet feeding direction, and against which a side end of the sheet with respect to a widthwise direction of the sheet is abutted;

an obliquely feeding roller pair configured to obliquely feed the sheet in an inclination direction relative to the sheet feeding direction so that the sheet approaches said abutment member in the widthwise direction;

a second feeding roller pair provided downstream of said obliquely feeding roller pair with respect to the sheet feeding direction and configured to feed the sheet;

a first contact-and-separation mechanism configured to contact and separate said first feeding roller pair so as to be changeable between a first feedable state in which said first feeding roller pair is capable of feeding the sheet while nipping the sheet and a first separated state in which rollers of said first feeding roller pair are in separation from each other;

a second contact-and-separation mechanism configured to contact and separate said obliquely feeding roller pair so as to be changeable between a second feedable state in which said obliquely feeding roller pair is capable of feeding the sheet while nipping the sheet and a second separated state in which rollers of said obliquely feeding roller pair are in separation from each other, and a control portion configured to control said feeding portion, said first feeding roller pair, said obliquely feeding roller pair, said first contact-and-separation mechanism, and said second contact-and-separation mechanism, wherein when the sheet fed has a first length, said control portion performs a first sequence of feeding, wherein in the first sequence of feeding, (i) feeding of the sheet is stopped after a leading edge of the sheet has been fed to a downstream side of said first feeding roller pair and an upstream side of said second feeding roller pair by said feeding portion, in a state in which said first feeding roller pair is put in the first separated state by said first contact-and-separation mechanism and in a state in which said obliquely feeding roller pair is put in the second separated state by said second contact-and-separation mechanism, and then (ii) feeding of the sheet in stopped state is resumed in a state in which said first feeding roller pair has been changed from the first separated state to the first feedable state and in a state in which said obliquely feeding roller pair is put in the second separated state by said second contact-and-separation mechanism, and then (iii) the sheet is fed to said second feeding roller pair by the first feeding roller pair, and wherein when the sheet fed has a second length shorter than the first length, said control portion performs a second sequence of feeding, wherein in the second sequence of feeding, (i) feeding of the sheet is stopped after a leading edge of the sheet has been fed to an upstream side of said second feeding roller pair by said first feeding roller pair in a state in which said first feeding roller pair is put in the first feedable state by said first contact-and-separation mechanism and in a state in which said obliquely feeding roller pair is put in the second feedable state by said second contact-and-separation mechanism, and then (ii) feeding of the sheet in stopped state is resumed in a state in which said first feeding roller pair has been changed from the first feedable state to the first separate state and in a state in which said obliquely feeding roller pair is put in the second feedable state by said second contact-and-separation mechanism, and then (iii) the sheet is fed by said obliquely feeding roller pair to said second feeding roller pair.

2. A sheet feeding device according to claim 1, wherein said first feeding roller pair is provided in plurality, and wherein when the sheet having the first length is fed, the feeding of the sheet is stopped and then is resumed in a state in which a part of said plurality of first feeding roller pairs is in the first separated state.

3. A sheet feeding device according to claim 2, wherein with respect to the sheet feeding direction, rollers of a most downstream one of said plurality of first feeding roller pairs are in contact with each other.

4. A sheet feeding device according to claim 1, in a state in which said first feeding roller pair and said obliquely feeding roller pair are in the first separated state and the second separated state, respectively, the sheet fed by the feeding portion is stopped so that a leading end of the sheet is positioned between said obliquely feeding roller pair and said second feeding roller pair with respect to the sheet feeding direction.

5. A sheet feeding device according to claim 1, wherein during the feeding of the sheet having the first length by said second feeding roller pair, said first feeding roller pair has been changed from the first feedable state to the first separated state.

6. A sheet feeding device according to claim 1, further comprising:

a first driving portion configured to drive said first feeding roller pair; and a second driving portion configured to drive said obliquely feeding roller pair, wherein in a case that the sheet fed has the first length, when the sheet is fed to the upstream side of said second feeding roller pair by said feeding portion, drive of said first driving portion and drive of said second driving portion are stopped in a state in which said first feeding roller pair is in the first separated state and said obliquely feeding roller pair is in the second separated state, and wherein after the feeding of the sheet is stopped, the feeding of the sheet having the first length is resumed by said first feeding roller pair by starting the drive of said first driving portion in a state in which the drive of said second driving portion is stopped in the state in which said obliquely feeding roller pair is in the second separated state and after said first feeding roller pair has been changed from the first separated state to the first feedable state.

7. A sheet feeding device according to claim 1, wherein the sheet having the first length is longer than a distance from a downstream end of said side end regulating portion to said obliquely feeding roller pair with respect to the sheet feeding direction.

8. A sheet feeding device according to claim 1, wherein said feeding portion includes a feeding roller pair configured to feed the sheet supported by said sheet supporting portion and includes a downstream feeding roller pair provided downstream of said feeding roller pair with respect to the sheet feeding direction and configured to feed the sheet fed by said feeding roller pair, and wherein each of said feeding roller pair and said downstream feeding roller pair feeds the sheet in a feedable state in which the sheet is feedable in a nipped state.

9. An image forming apparatus comprising:

a sheet feeding device according to claim 1; and an image forming portion configured to form an image on the sheet fed by said sheet feeding device.

* * * * *